US009551544B1

(12) United States Patent
Kempf

(10) Patent No.: US 9,551,544 B1
(45) Date of Patent: Jan. 24, 2017

(54) CROSSBOW LOCK MECHANISM

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 0 days.

(21) Appl. No.: 14/974,262

(22) Filed: Dec. 18, 2015

Related U.S. Application Data

(63) Continuation-in-part of application No. 14/146,177, filed on Jan. 2, 2014, now Pat. No. 9,255,754.

(51) Int. Cl.
*F41B 5/12* (2006.01)
*F41A 17/46* (2006.01)
*F41B 5/14* (2006.01)

(52) U.S. Cl.
CPC ..... *F41A 17/46* (2013.01); *F41B 5/1403* (2013.01)

(58) Field of Classification Search
CPC ..... F41B 5/12; F41B 5/123; F41A 19/10; F41A 19/16
See application file for complete search history.

(56) References Cited

U.S. PATENT DOCUMENTS 2,679,706 A * 6/1954 Windle ..... F41A 17/20 42/70.08
2,775,051 A * 12/1956 Gehman ..... F41A 17/20 42/41
2,786,461 A * 3/1957 Pelsue, Jr. ..... F41B 5/12 124/25
4,671,005 A * 6/1987 Jewell ..... F41A 17/46 42/69.02
4,721,092 A * 1/1988 Waiser ..... F41B 5/1469 124/25
4,877,008 A * 10/1989 Troubridge ..... F41B 5/1469 124/25
4,926,574 A * 5/1990 Rieger ..... F41A 19/34 42/70.04
5,649,520 A * 7/1997 Bednar ..... F41B 5/12 124/25
5,884,614 A 3/1999 Darlington et al.
6,205,990 B1 3/2001 Adkins
6,736,123 B1 5/2004 Summers et al.
7,770,567 B1 * 8/2010 Yehle ..... F41A 17/46 124/25
7,814,894 B2 10/2010 Giroux
8,985,091 B2 * 3/2015 Miao ..... 124/25
2009/0194086 A1 * 8/2009 Kempf ..... F41A 19/10 124/25

(Continued)

*Primary Examiner* — Melba Bumgarner
*Assistant Examiner* — Amir Klayman
(74) *Attorney, Agent, or Firm* — Donald J. Ersler

(57) ABSTRACT

An improved crossbow lock mechanism includes the trigger housing, the seer lever, the seer lock lever, the latch, the trigger and an auto safety. The auto safety preferably includes a safety block, a safety lever arm and a safety lever arm lock. The safety lever arm lock is pivotally retained on one end of the safety lever arm with a safety arm lock pin. A finger engagement portion extends from one end of the safety lever arm lock and a stop portion extends from an opposing end thereof. A hand grip extends from the housing. The safety lever arm is pivotally retained in the hand grip with a safety lever arm pivot pin. A safety block actuator pocket is formed in a bottom of the safety block to receive the other end of the safety lever arm. A safety block spring biases the safety block away from the trigger lever.

12 Claims, 11 Drawing Sheets

(56) References Cited

U.S. PATENT DOCUMENTS

| | | | | |
|---|---|---|---|---|
| 2014/0102431 | A1* | 4/2014 | Kennedy | F41B 5/12<br>124/35.1 |
| 2015/0260477 | A1* | 9/2015 | Khoshnood | F41A 19/06<br>124/25 |
| 2016/0076842 | A1* | 3/2016 | Faxon | F41A 17/22<br>42/69.01 |

* cited by examiner

CROSSBOW LOCK MECHANISM

CROSS-REFERENCES TO RELATED APPLICATIONS

This is a continuation-in-part application taking priority from patent application Ser. No. 14/146,177, filed on Jan. 2, 2014.

BACKGROUND OF THE INVENTION

Field of the Invention

The present invention relates generally to archery and more specifically to an improved crossbow lock mechanism, which has fewer moving parts than that of the prior art.

Discussion of the Prior Art

U.S. Pat. No. 5,884,614 to Darlington et al. discloses a crossbow with improved trigger mechanism. U.S. Pat. No. 6,205,990 discloses a dry-fire prevention mechanism for crossbows. U.S. Pat. No. 6,736,123 to Summers et al. discloses a crossbow trigger. U.S. Pat. No. 7,814,984 to Giroux discloses a anti dry-fire device for crossbows.

Accordingly, there is a clearly felt need in the art for an improved crossbow lock mechanism, which prevents dry firing and has fewer moving parts than that of the prior art.

SUMMARY OF THE INVENTION

The present invention provides an improved crossbow lock mechanism, which prevents dry firing. A crossbow includes a riser, a barrel, two bow limbs, two cams, a bow string, a trigger housing and a stock. The two bow limbs extend from opposing sides of the riser at one end thereof. An opposing end of the riser extends from one end of the barrel and the stock extends from an opposing end of the barrel. Each bow limb is terminated with one of the two cams. The bow string is retained on the two cams. The trigger housing is contained within the stock.

The improved crossbow lock mechanism preferably includes the trigger housing, a seer lever, a seer lock lever, a latch and a trigger. The trigger housing includes a component half and a cover half. A mechanism cavity is formed in the component half to receive and retain the seer lever, the seer lock lever and the latch. The seer lever includes a seer base, an anti-dryfiring projection, a latch projection, and an elongated pivot link. The anti-dryfiring projection extends from one end of the seer base and the elongated pivot link extends from an opposing end of the seer base. The latch projection extends outward from a length of the seer base. One end of the elongated pivot link is pivotally retained in the component half. An opposing end of the elongated pivot link is pivotally retained by the trigger.

The trigger includes a trigger lever and a trigger link. An end of the trigger lever is pivotally retained on the barrel. One end of the trigger link is pivotally retained on the trigger lever, adjacent the trigger lever pivot point. The other end of the trigger link is pivotally retained on an opposing end of the pivot link. The latch includes a latch base, an arrow shaft yoke, a seer notch and a spring projection. The arrow shaft yoke extends from one side of the latch base and the spring projection extends from an opposing side of the latch base at one end thereof. The seer notch is formed in an opposing end of the latch base. The latch is pivotally retained in the mechanism cavity adjacent the spring projection. The seer notch engages the latch projection.

The seer lock lever includes a latch finger and an impact finger. The latch finger extends from one end of the seer lock lever and the impact finger extends from an opposing end of the seer lock lever. The latch finger is sized to capture the anti-dryfiring projection. A seer lever stop extends outward from the mechanism cavity in the component half, above the seer base and between the anti-dry firing projection and the latch projection to stop excessive upward motion of the seer lever. A latch ball stop is preferably retained between the impact finger and the seer lever stop, but may have other suitable locations.

In use, the bow string is pulled back, until the seer notch of the latch is locked behind the latch projection of the seer lever. A nock of an arrow shaft is moved over the bow string and placed in the arrow shaft yoke. The trigger lever is pulled, which causes the trigger linkage to push the seer lever downward. The latch projection moves downward and allows the opposing end of the latch base to pass by the latch projection and release the bow string from the cross bow. The latch ball stop provides a cushioned impact for latch.

A second embodiment of an improved crossbow lock mechanism includes the trigger housing, the seer lever, the seer lock lever, the latch, the trigger and an auto safety. The auto safety replaces the safety. The auto safety preferably includes a safety block, a safety lever arm and a safety lever arm lock. The safety lever arm lock is pivotally retained on one end of the safety lever arm with a safety arm lock pin. A finger engagement portion extends from one end of the safety lever arm lock and a stop portion extends from an opposing end thereof. A safety lever lock spring is retained on the safety lever arm lock pin to bias the stop portion away from safety lever arm. A hand grip extends from the housing. The safety lever arm is pivotally retained in the hand grip with a safety lever arm pivot pin. A safety lever arm projection is formed on an opposing end of the safety lever arm. A safety block actuator pocket is formed in a bottom of the safety block to receive the safety lever arm projection. A safety block spring biases the safety block away from the trigger lever. A safety lever arm lock stop is formed on an inside surface of the hand grip adjacent a bottom thereof.

Accordingly, it is an object of the present invention to provide an improved crossbow lock mechanism, which prevents dry firing and has fewer moving parts than that of the prior art.

These and additional objects, advantages, features and benefits of the present invention will become apparent from the following specification.

DETAILED DESCRIPTION OF THE PREFERRED EMBODIMENTS

Figure 1:
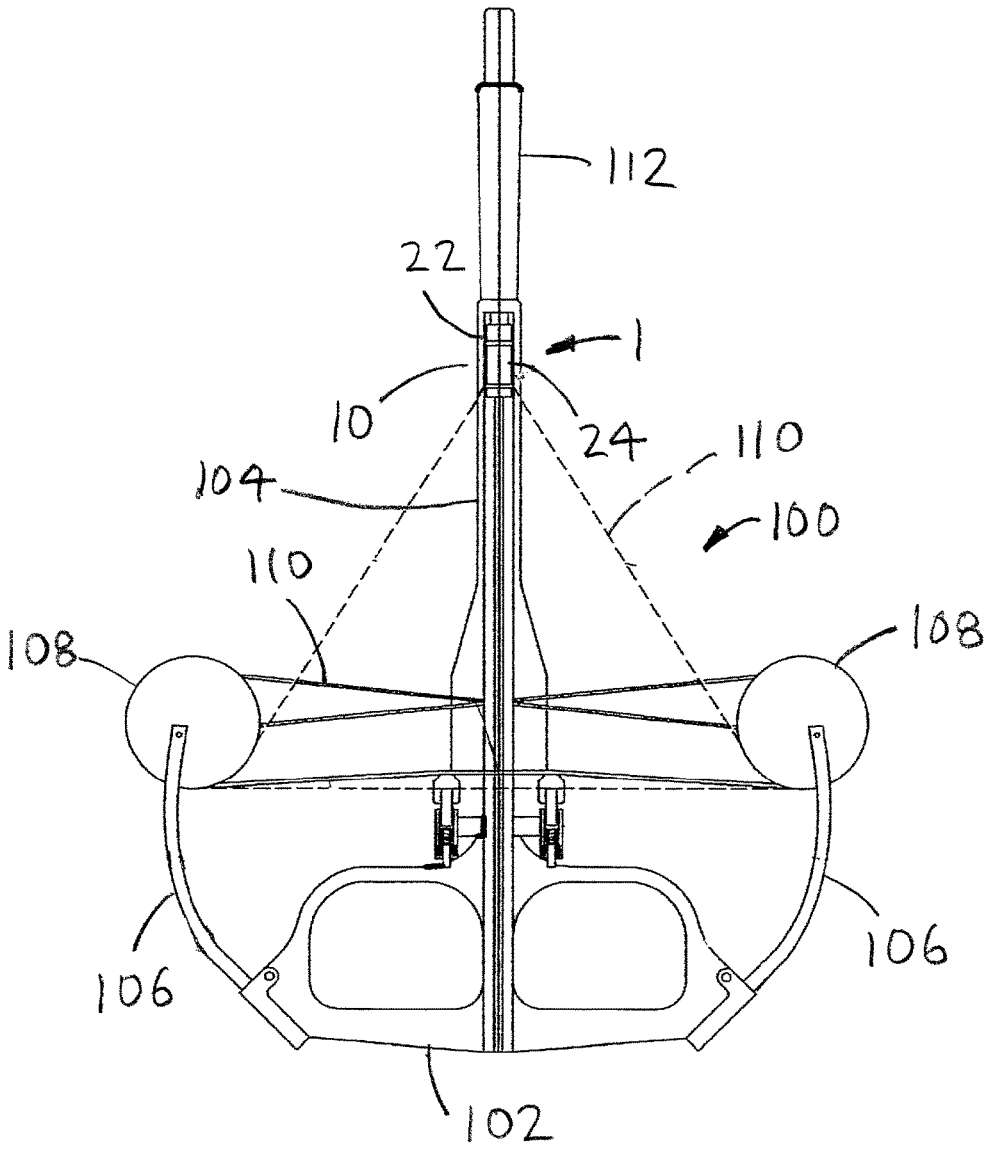
FIG. 1 is a top view of a crossbow of including an improved crossbow lock mechanism in accordance with the present invention.

With reference now to the drawings, and particularly to FIG. 1, there is shown a top view of a crossbow 100 of including an improved crossbow lock mechanism 1. The crossbow 100 includes a riser 102, a barrel 104, two bow limbs 106, two cams 108, a bow string 110, a stock 112 and a trigger housing 10. The two bow limbs 106 extend from opposing sides of the riser 102 at one end thereof. An opposing end of the riser 102 extends from one end of the barrel 104. The stock 112 extends from an opposing end of the barrel 104. Each bow limb 106 is terminated with one of the two cams 108. The bow string 110 is retained on the two cams 108. The trigger housing 10 is contained within the stock 112.

Figure 2:
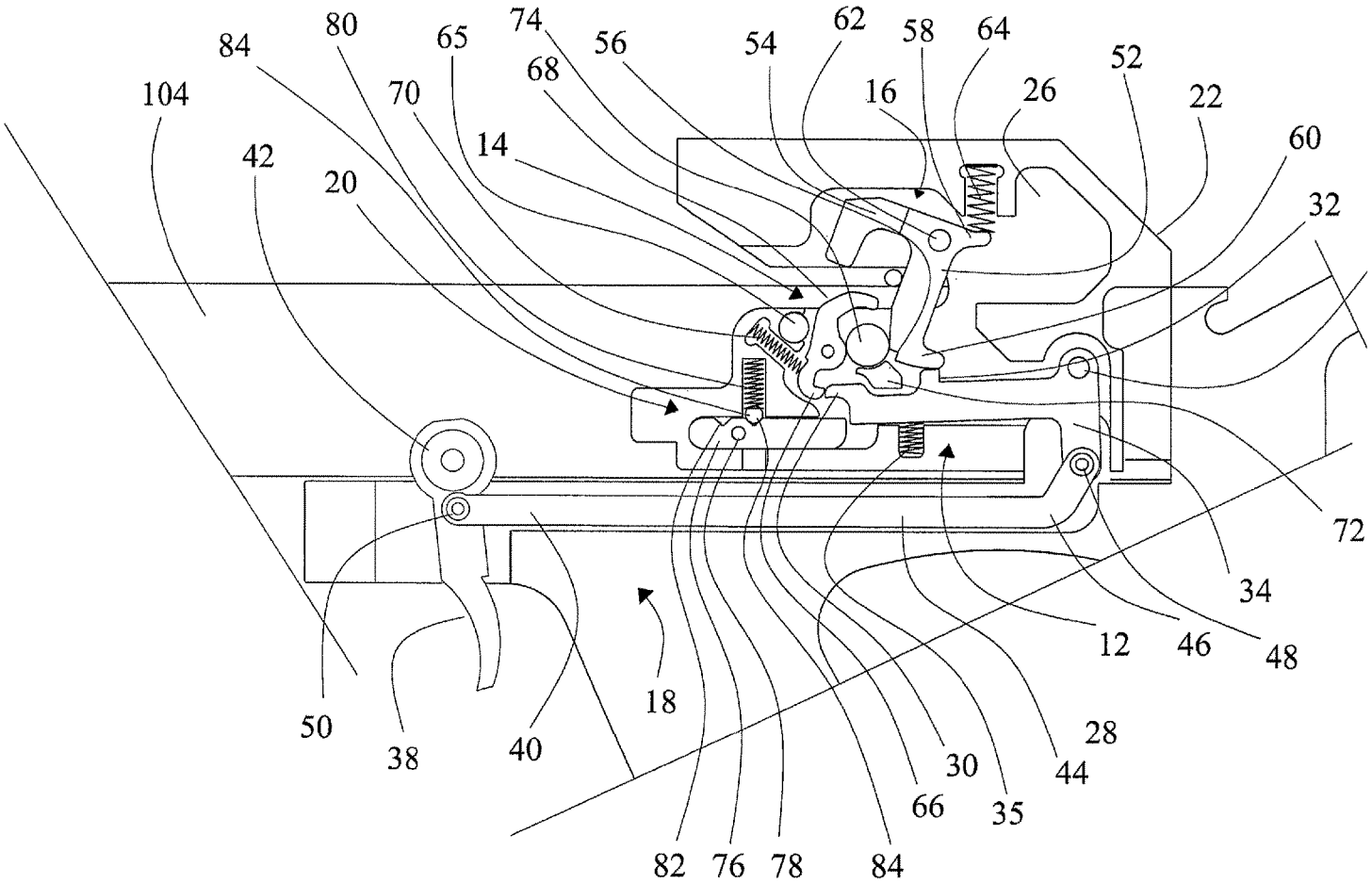
FIG. 2 is a side view of an improved crossbow lock mechanism with a cover half removed and illustrating a bow string pulled against a latch while cocking the latch in accordance with the present invention.
Figure 3:
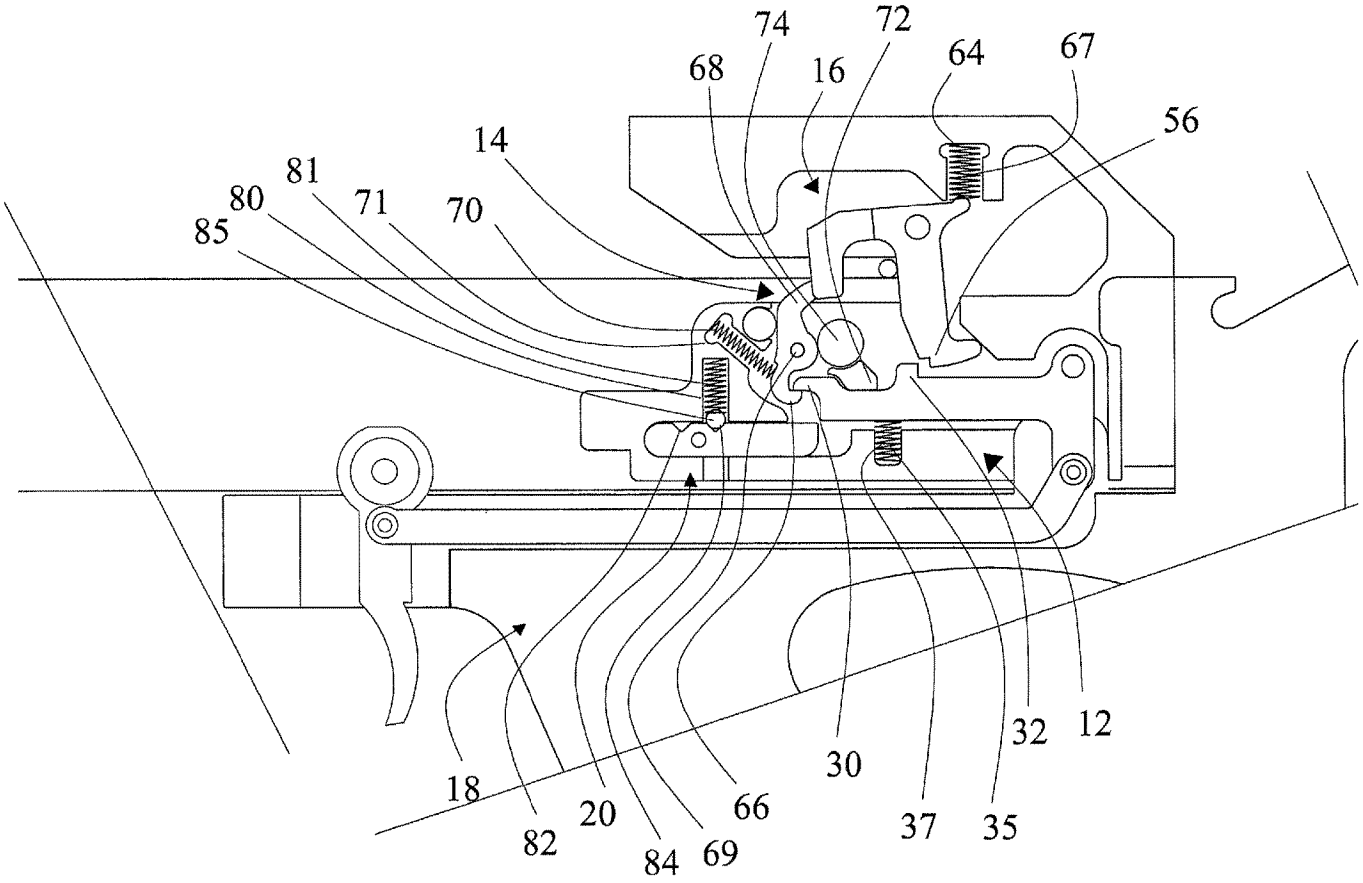
FIG. 3 is a side view of an improved crossbow lock mechanism with a cover half removed and illustrating a bow string pulled past a cocked position in accordance with the present invention.
Figure 4:
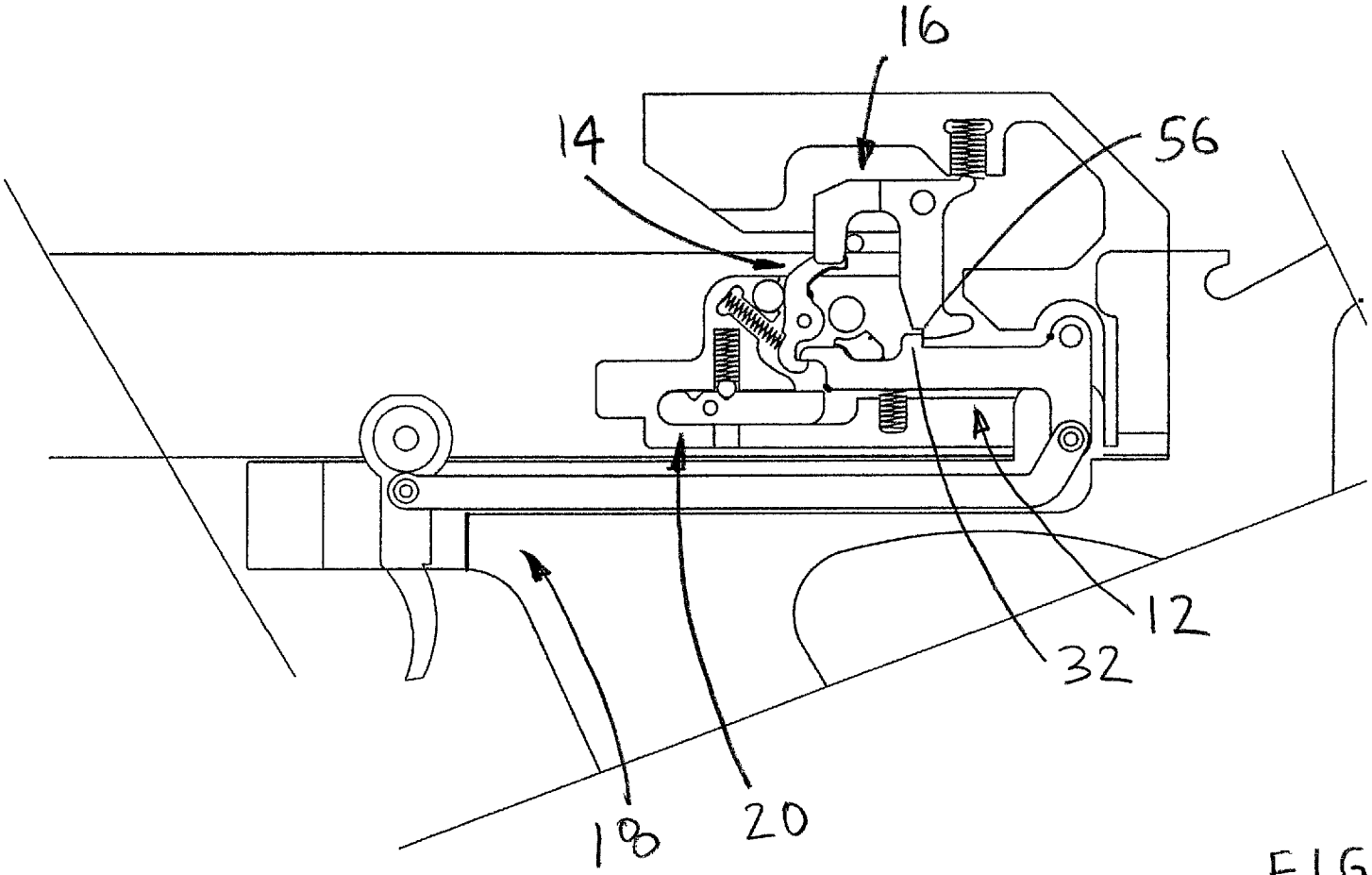
FIG. 4 is a side view of an improved crossbow lock mechanism with a cover half removed and illustrating a bow string in a cocked position with a safety in an off position in accordance with the present invention.

With reference to FIGS. 2-3, the improved crossbow lock mechanism 1 preferably includes the trigger housing 10, a seer lever 12, a seer lock lever 14, a latch 16, a trigger 18 and a safety 20. The trigger housing 10 includes a component half 22 and a cover half 24. A mechanism cavity 26 is formed in the component half 22 to receive and retain the seer lever 12, the seer lock lever 14, the latch 16 and the safety 20. The seer lever 12 includes a seer base 28, an anti-dryfiring projection 30, a latch projection 32, and an elongated pivot link 34. The anti-dryfiring projection 30 extends from one end of the seer base 28 and the elongated pivot link 34 extends from an opposing end of the seer base 28, substantially perpendicular to the seer base 28. The latch projection 32 extends outward from a length of the seer base 28. One end of the pivot link 34 is pivotally retained in the component half 22 with a seer pivot pin 36. A seer compression spring 35 is retained in a seer spring cavity 37. The seer compression spring 35 biases the seer lever 12 toward the latch 16. The trigger 18 includes a trigger lever 38 and a trigger link 40. An end of the trigger lever 38 is pivotally retained on the barrel 104 with a fastener 42 or the like. The trigger link 40 includes an elongated body 44 and an end leg 46. The end leg 46 preferably extends outward from one end of the elongated body 44 at an obtuse angle. An opposing end of the elongated pivot link 34 is pivotally retained by an end of the end leg 46 with a pivot pin 48. An opposing end of the trigger link 44 is pivotally retained on the trigger lever 38, adjacent the fastener 42 with a pivot pin 50.

The latch 16 includes a latch base 52, an arrow shaft yoke 54, a seer notch 56, a spring projection 58 and a latch foot 60. The arrow shaft yoke 54 extends from one side of the latch base 52 and the spring projection 58 extends from an opposing side of the latch base 52 at one end thereof. The seer notch 56 is formed on the one side of the latch base 52 and the latch foot 60 is formed on the opposing side of the latch base 52 at an opposing end thereof. The one end of the latch base 52 is pivotally retained in the mechanism cavity 26 with a pivot pin 62, adjacent the spring projection 58. A latch spring 64 is retained in a latch spring cavity 67. The latch spring 64 contacts the spring projection 58 and biases the latch foot 60 to contact the latch projection 32. With reference to FIGS. 3-6, the seer notch 56 engages the latch projection 32 to place the improved crossbow lock mechanism 1 is in a cocked position.

The seer lock lever 14 includes a latch finger 66 and an impact finger 68. The seer lock lever 14 is retained in the mechanism cavity 26 with a pivot pin 69. The latch finger 66 extends from one end of the seer lock lever 14 and the impact finger 68 extends from an opposing end of the seer lock lever 14. A seer lock lever ball stop 65 is preferably located behind the impact finger 68, but may have other suitable locations. The seer lock lever ball stop 65 is preferably fabricated from a rubber material, but other resilient materials may also be used. The seer lock lever ball stop 65 provides an impact cushion for the impact finger 68.

With reference to FIG. 3, the latch finger 66 is sized to capture the anti-dryfiring projection 30. A lock spring 70 is retained in a lock spring cavity 71. A lock spring 70 biases the latch finger 66 toward the anti-dryfiring projection 30. A seer lever stop 72 extends outward from the mechanism cavity 26 in the component half 22, above the seer base 28 and between the anti-dry firing projection 30 and the latch projection 32 to stop excessive upward motion of the seer lever 12. A latch ball stop 74 is preferably retained between the seer lock lever 14 and the seer lever stop 72, but may have other suitable locations. The latch ball stop 74 is preferably fabricated from a rubber material, but other resilient materials may also be used. The latch ball stop 74 provides an impact cushion for the seer lock lever 14 and the latch 16.

Figure 5:
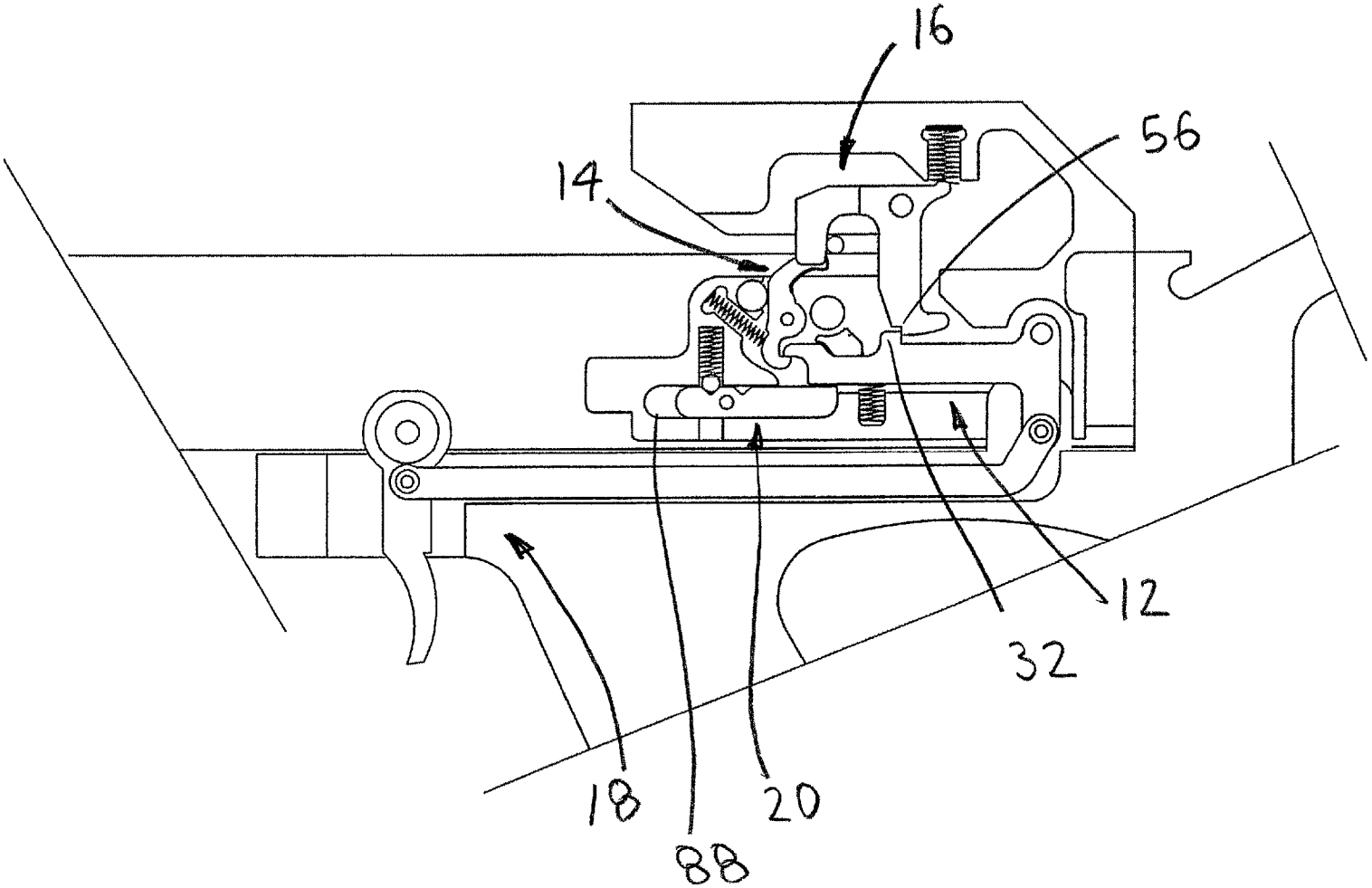
FIG. 5 is a side view of an improved crossbow lock mechanism with a cover half removed and illustrating a bow string in a cocked position with a safety in an on position in accordance with the present invention.

The safety 20 includes a lock bar 76, a slide pin 78 and a position lock spring 80. A lock notch 82 and a fire notch 84 are formed in a top of the lock bar 76. A notch ball 85 engages the lock and fire notches 82, 84 and is biased toward the lock bar 76 with the position lock spring 80. The position lock spring 80 is retained in a position lock cavity 81. The slide pin 78 is pressed through the lock bar 76. With reference to FIG. 5, a slot 86 is formed through the component half 22 and the cover half 24 (not shown) to provide clearance for the slide pin 78 and allow the safety 30 to be shuttled between a locked position and a fire position. The lock bar 76 is maintained in position by the position lock spring 80 forcing the notch ball 85 into the lock notch 82 or the fire notch 84. With reference to FIG. 5, the lock bar 76 is retained in a safety cavity 88 formed in the component half 22.

Figure 6:
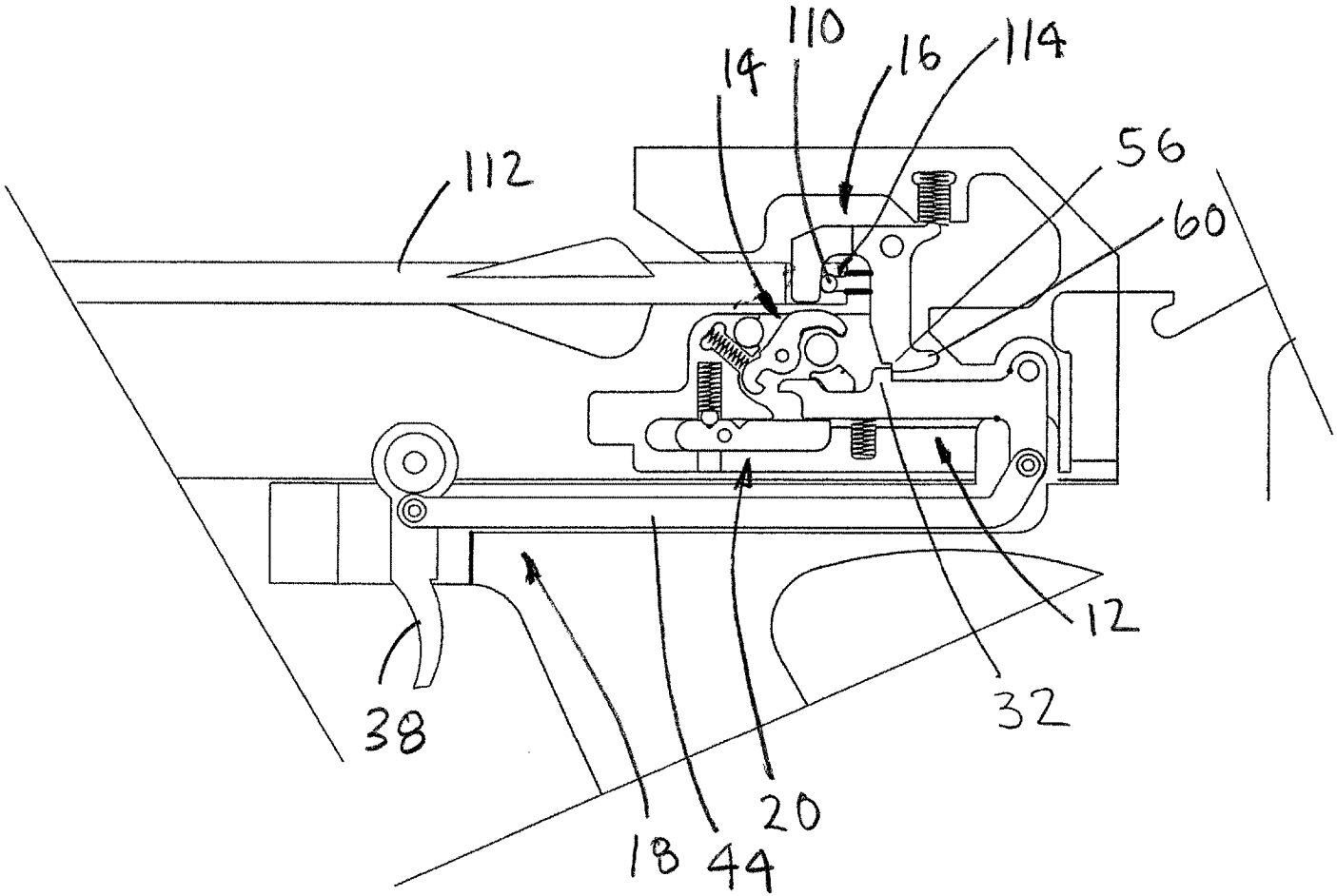
FIG. 6 is a side view of an improved crossbow lock mechanism with a cover half removed and illustrating a bow string in a cocked position with a safety in an on position with an arrow ready to be fired in accordance with the present invention.
Figure 7:
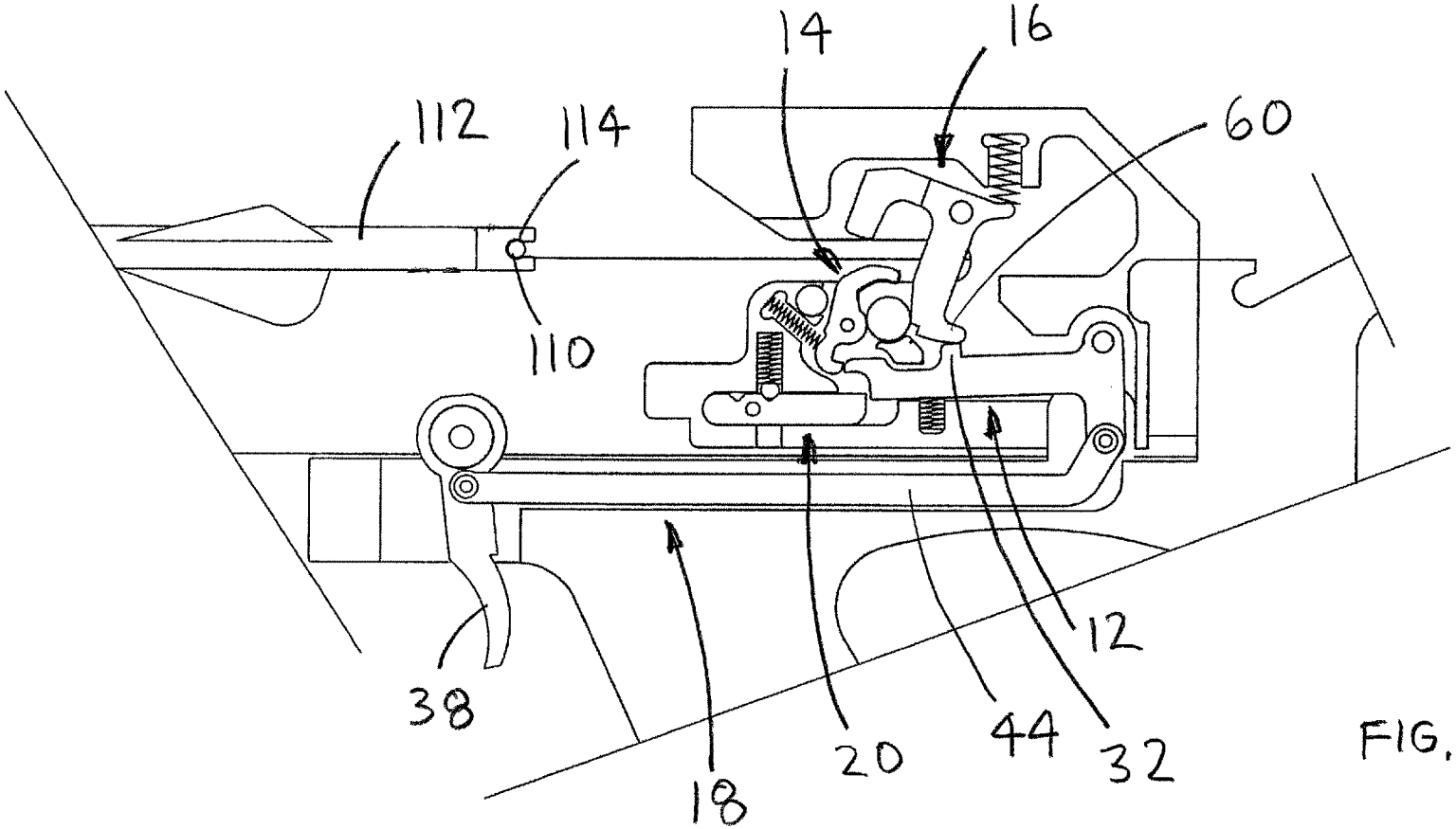
FIG. 7 is a side view of an improved crossbow lock mechanism with a cover half removed and illustrating an arrow just fired in accordance with the present invention.

With reference to FIGS. 6-7, the improved crossbow lock mechanism 1 works in the following manner. The bow string 110 is pulled back, until the seer notch 56 of the latch 16 is locked behind the latch projection 32 of the seer lever 12. A nock 114 of an arrow shaft 112 is inserted over the bow string 110. The trigger lever 38 is pulled, which causes the trigger linkage 44 to push the seer lever downward 12. The latch projection 32 moves downward and allows the opposing end of the latch foot 60 to pass by the latch projection 32 and release the bow string 110 from the cross bow 100.

Figure 8:
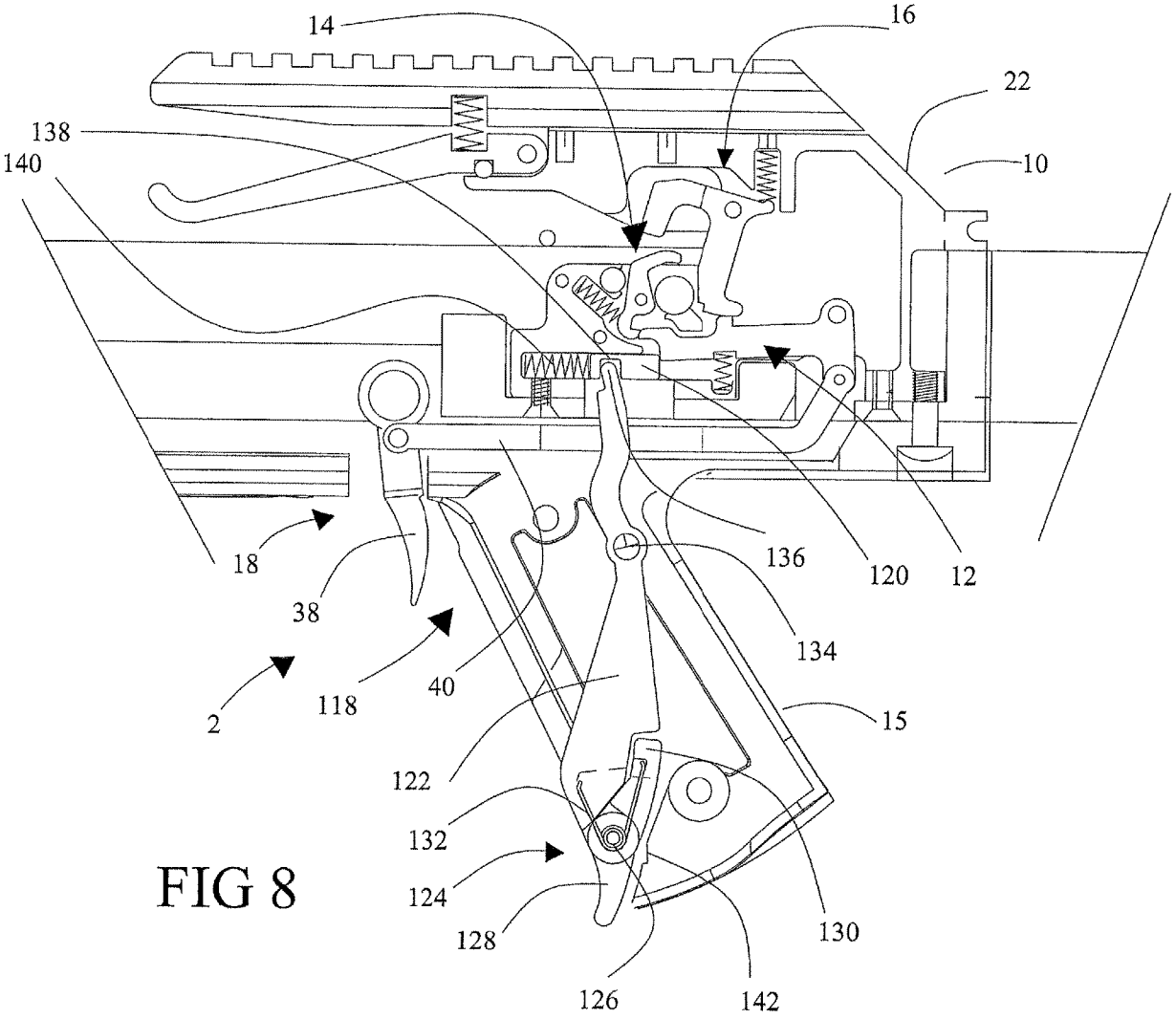
FIG. 8 is a side view of a second embodiment of an improved crossbow lock mechanism with an auto safety in a "just fired" and "ready to cock" position in accordance with the present invention.

With reference to FIGS. 1-3, the improved crossbow lock mechanism 1 preferably includes the trigger housing 10, a seer lever 12, a seer lock lever 14, a latch 16, a trigger 18 and a safety 20. With reference to FIG. 8, a second embodiment of an improved crossbow lock mechanism 2 includes the trigger housing 10, the seer lever 12, the seer lock lever 14, the latch 16, the trigger 18 and an auto safety 118. The auto safety 118 replaces the safety 20. The auto safety 118 preferably includes a safety block 120, a safety lever arm 122 and a safety lever arm lock 124. The safety lever arm lock 124 is pivotally retained on one end of the safety lever arm 122 with a safety arm lock pin 126. A finger engagement portion 128 extends from one end of the safety lever arm lock 124 and a stop portion 130 extends from an opposing end thereof. A safety lever lock spring 132 is retained on the safety lever arm lock pin 126 to bias the stop portion 130 away from safety lever arm 122. The safety lever lock spring 132 is preferably a torsion spring, but other springs may also be used. A hand grip 15 extends from the housing 10. The safety lever arm 122 is pivotally retained in the hand grip 15 with a safety lever arm pivot pin 134. A safety lever arm projection 136 is formed on an opposing end of the safety lever arm 122. A safety block actuator pocket 138 is formed in a bottom of the safety block 120 to receive the safety lever arm projection 136. A safety block spring 140 biases the safety block 120 away from the trigger lever 38. The safety block spring 140 is preferably a compression spring. A safety lever arm lock stop 142 is formed on an inside surface of the hand grip 15 adjacent a bottom thereof. The safety lever arm lock stop 142 is preferably a notch. FIG. 8 shows the auto safety 118 of the improved crossbow lock mechanism 2 in a "just fired" and "ready to cock" position.

Figure 9:
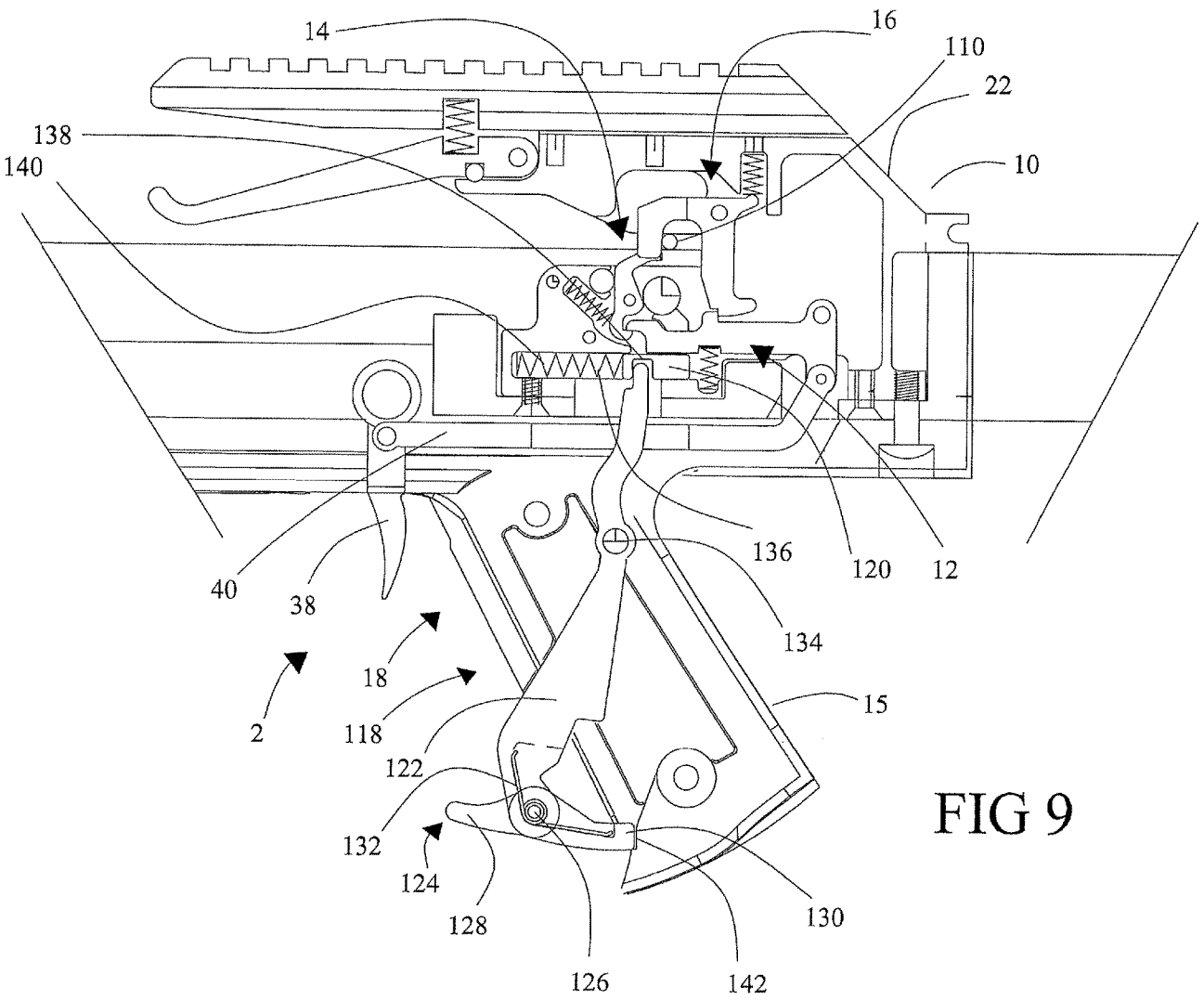
FIG. 9 is a side view of a second embodiment of an improved crossbow lock mechanism with an auto safety engaged and in a cocked position in accordance with the present invention.

With reference to FIG. 9, the safety block 120 is biased towards the seer lever 12 with the safety block spring 140. As the bowstring 110 is drawn back into the latch 16; the latch 16 rotates to a position, which simultaneously engages the latch 16 with the seer lever 12, the seer lock lever 14, and the safety block 120. At the same time, when the safety block 120 is pushed rearwards, movement of the safety block 120 forces the safety lever arm projection 136 to pivot away from the trigger lever 38. As the safety block 120 moves rearwards, the safety lever arm 122 pivots on the safety lever arm pivot pin 134, causing the lower portion of the safety lever arm 122 to move toward the trigger lever 38. As the safety lever arm 122 moves toward the trigger lever 38, the safety lever lock spring 132 forces the rotation of the safety lever arm lock 124. The safety lever arm lock 124 rotates, until the stop portion 130 of the safety lever arm lock 130 engages the safety lever arm lock stop 142, which completes the cycle of the improved crossbow lock mechanism 2.

Figure 10:
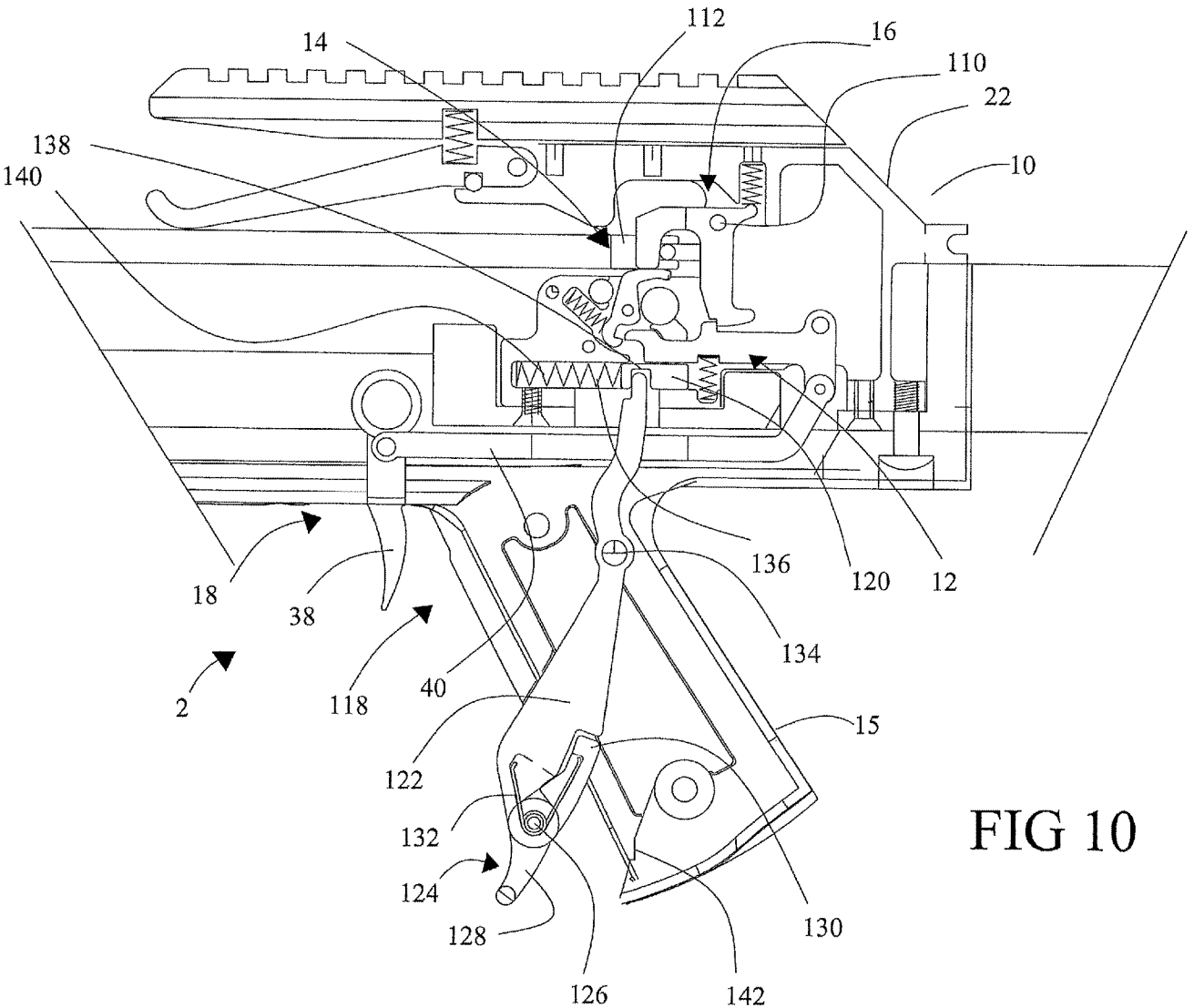
FIG. 10 is a side view of a second embodiment of an improved crossbow lock mechanism having an auto safety with a safety lever arm lock rotated to a position that has disengaged a stop portion of the safety lever arm lock in accordance with the present invention.
Figure 11:
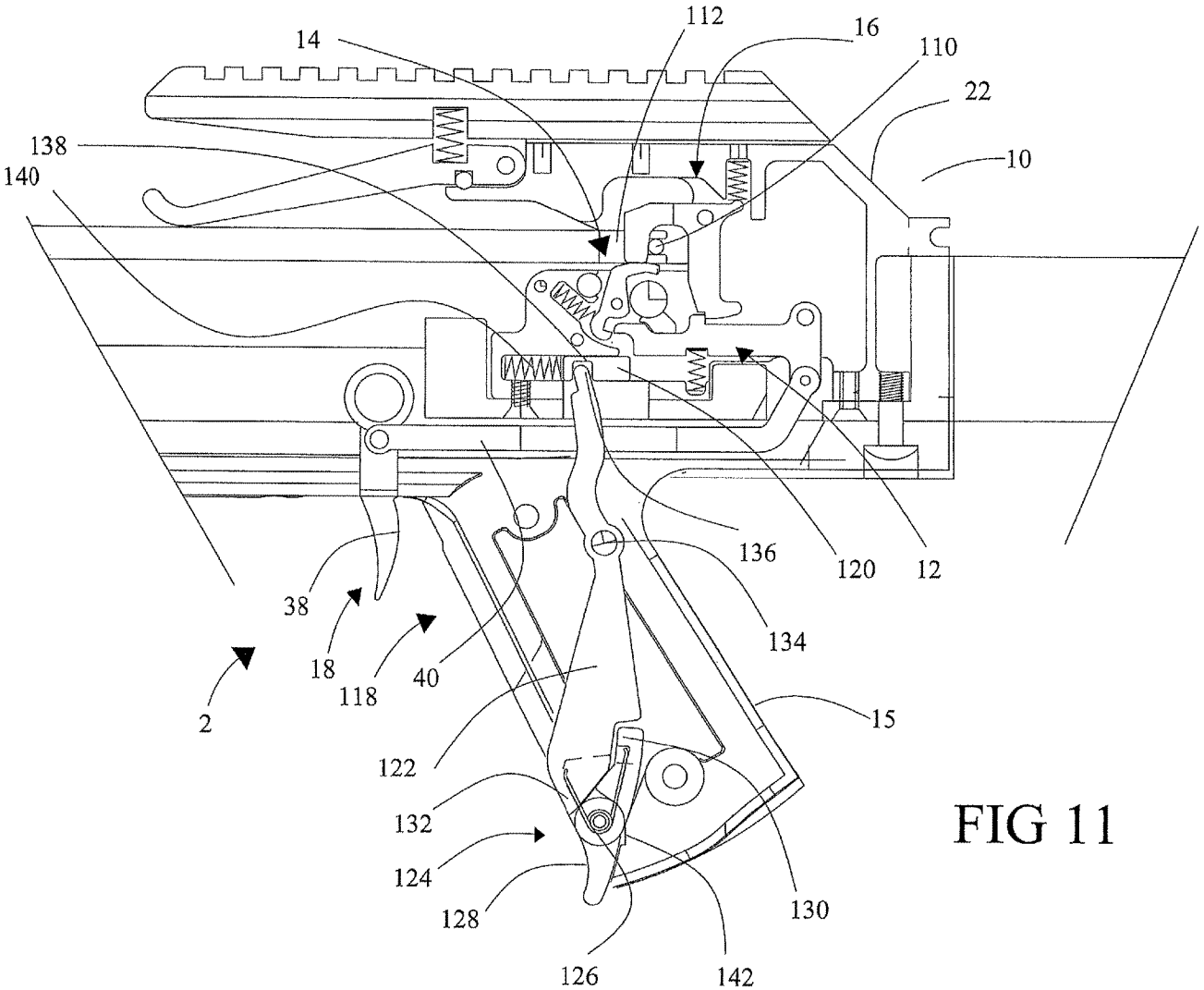
FIG. 11 is a side view of a second embodiment of an improved crossbow lock mechanism with an auto safety in a "ready to fire position" in accordance with the present invention.

With reference to FIGS. 10-11, when the user is ready to fire the crossbow 100, the user loads an arrow 112 into the improved crossbow lock mechanism 2, causing the rotation of the seer lock lever 14, which disengages the seer lock lever 14 from the seer lever 20. Downward pressure is applied to the finger engagement portion 128 of the safety lever lock 124, which causes rotation of the safety lever lock 124 and disengagement of the stop portion 130 of the safety lever arm 124 from the safety lever arm lock stop 142. As the safety lever arm lock 124 rotates as described, the safety lever arm 122 rotates on the safety lever arm pivot pin 134, which in turn causes movement of the safety block 120 toward the trigger lever 38. The trigger lever 38 may now be pulled rearwards, causing the trigger link 40 to pivot the seer lever 12, thus disengaging the seer lever 12 from the latch 16 and firing the arrow from the crossbow.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An automatic safety device for a crossbow trigger mechanism, comprising:

a crossbow trigger mechanism retained in a trigger housing of a crossbow;

a hand grip extends downward from the trigger housing;

a safety block is slidably engaged with the crossbow trigger mechanism, wherein said safety block prevents firing of the crossbow in a first position, said safety block slides from said first position to a second position, said safety block allows firing of the crossbow in said second position;

a safety lever arm lock; and a safety lever arm having said safety lever arm lock pivotally retained on one end thereof, a safety lever arm lock stop is formed on an inside surface of the hand grip adjacent a bottom thereof to retain one end of said safety lever arm lock, an opposing end of said safety lever arm lock is used to pivot said one end of said safety lever arm lock into said safety lever arm lock stop, an opposing end of said safety lever arm is engaged with said safety block, said safety lever arm is pivotally retained in the hand grip, wherein one end of said safety lever arm lock is biased away from said safety lever arm with a safety lever lock spring, said one end of said safety lever arm lock is retained in said safety lever arm lock stop to prevent firing of the crossbow.

2. The automatic safety device for a crossbow trigger mechanism of claim 1 wherein:

a pocket is formed in a bottom of said safety block to receive said opposing end of said safety lever arm.

3. The automatic safety device for a crossbow trigger mechanism of claim 1 wherein:

a finger engagement portion is formed on an opposing end of said safety lever arm lock.

4. The automatic safety device for a crossbow trigger mechanism of claim 1, further comprising:

a torsion spring for biasing said one end of said safety lever arm lock.

5. An improved crossbow lock mechanism to retain in a trigger housing of a crossbow, comprising:

a trigger housing of a crossbow;

a hand grip extends downward from the trigger housing;

a safety block is slidably retained in the trigger housing, wherein said safety block prevents firing of the crossbow in a first position, said safety block slides from said first position to a second position, said safety block allows firing of the crossbow in said second position;

a seer lever includes a latch projection, said seer lever pivots relative to said trigger housing;

a latch includes a seer notch and an arrow shaft yoke, said latch pivots relative to the trigger housing, said arrow shaft yoke is sized to receive a nock of an arrow shaft, wherein said latch projection is positioned to engage said seer notch when said improved crossbow lock mechanism is cocked, said arrow shaft yoke retains a bow string in a cocked position;

a trigger pivots relative to said trigger housing, said trigger is linked to said seer lever, wherein actuating said trigger causes said latch projection to release said latch, and the bow string;

a safety lever arm lock; and a safety lever arm having said safety lever arm lock pivotally retained on one end thereof, a safety lever arm lock stop is formed on an inside surface of the hand grip adjacent a bottom thereof to retain one end of said safety lever arm lock, an opposing end of said safety lever arm lock is used to pivot said one end of said safety lever arm lock into said safety lever arm lock stop, an opposing end of said safety lever arm is engaged with said safety block, said safety lever arm is pivotally retained in the hand grip, wherein one end of said safety lever arm lock is biased away from said safety lever arm with a safety lever lock spring, said one end of said safety lever arm lock is retained in said safety lever arm lock stop to prevent firing of the crossbow.

6. The improved crossbow lock mechanism of claim 5 wherein:

a pocket is formed in a bottom of said safety block to receive said opposing end of said safety lever arm.

7. The improved crossbow lock mechanism of claim 5 wherein:

a lock stop is formed on one end of said safety lever arm lock, wherein said lock stop engages a portion of the hand grip.

8. The improved crossbow lock mechanism of claim 7 wherein:

a finger engagement portion is formed on an opposing end of said safety lever arm lock.

9. The improved crossbow lock mechanism of claim 5, further comprising:

said trigger includes a trigger lever and a trigger linkage, said trigger lever is pivotally retained relative to said trigger housing, one end of said trigger linkage is pivotally retained by said trigger lever, the other end of said trigger linkage is pivotally connected to said seer lever.

10. The improved crossbow lock mechanism of claim 5, further comprising:

a seer lever stop is positioned above said seer lever.

11. The improved crossbow lock mechanism of claim 10, further comprising:

a latch ball stop is fabricated from a resilient material, said latch ball stop provides a cushion for said latch.

12. The improved crossbow lock mechanism of claim 5 wherein:

said trigger housing includes a component half and a cover half, a mechanism cavity is formed in said component half to retain at least said seer lever and said latch.

* * * * *